US007407454B2

(12) United States Patent
Guy

(10) Patent No.: US 7,407,454 B2
(45) Date of Patent: Aug. 5, 2008

(54) EQUIPMENT THREADER AND CARRIER FOR STICK SPORTS

(76) Inventor: Patrick James Guy, 23 Outlet Rd., Ballston Lake, NY (US) 12019

( * ) Notice: Subject to any disclaimer, the term of this patent is extended or adjusted under 35 U.S.C. 154(b) by 125 days.

(21) Appl. No.: 11/282,528

(22) Filed: Nov. 19, 2005

(65) Prior Publication Data

US 2006/0111204 A1 May 25, 2006

Related U.S. Application Data

(60) Provisional application No. 60/629,140, filed on Nov. 19, 2004.

(51) Int. Cl.
*A63B 59/02* (2006.01)
*A63B 65/12* (2006.01)

(52) U.S. Cl. ..... 473/505; 224/602

(58) Field of Classification Search ..... 473/513, 473/512, 505; D21/724; 182/6; 324/437; 224/602

See application file for complete search history.

(56) References Cited

U.S. PATENT DOCUMENTS

| | | | | |
|---|---|---|---|---|
| 2,650,590 | A * | 9/1953 | Moore et al. | 128/882 |
| 3,267,452 | A * | 8/1966 | Wolf | 324/437 |
| 4,897,044 | A * | 1/1990 | Rood | 439/504 |
| 6,638,101 | B1 * | 10/2003 | Botelho | 439/504 |
| 6,732,834 | B2 * | 5/2004 | Colorado | 182/6 |

* cited by examiner

*Primary Examiner*—Gene Kim
*Assistant Examiner*—M. Chambers

(57) ABSTRACT

A sports equipment carrier that is woven or threads through one or more pieces of sports equipment, then attaches to itself and finally attaches to the handle of a sports stick. It is a quick, open and secure way to carry equipment on its own separately or attached to the handle of a sports stick. This allows the user to carry the stick and equipment with the stick slung in an over the shoulder fashion. The stick can rest on the users shoulder while the equipment hangs from the handle of the stick behind the user. It can also be carried in the users hand by their side. The stick is easily inserted or removed for play while holding the gear/equipment together. The stick is also protected from damage that can occur from direct contact with the equipment.

3 Claims, 2 Drawing Sheets

EQUIPMENT THREADER AND CARRIER FOR STICK SPORTS

This application claims priority of U.S Provisional Application No. 60/629,140, filed Nov. 19, 2004.

BACKGROUND OF THE INVENTION

This invention concerns a device that is used as an equipment carrier for stick sports (lacrosse, hockey, field hockey, etc.). This device threads or is laced through the equipment, holding it together, then attaching the device and the equipment to the handle of a stick. This invention is used as a means to hold different pieces of equipment together, allowing the equipment to be carried as one. This device laces through each individual piece of equipment. The equipment is held together by the device and attaches to the handle of a stick, protecting the stick from direct contact with the equipment. This can be a three-step process. First, lacing the varying pieces of equipment onto the device, the handle prevents the equipment from sliding off the end. Secondly, the device handle can be placed through the large loop to hold the equipment in a bundle. It can then be carried at the user's side. Thirdly, sliding the stick handle through the handle of the device so it can be carried altogether over the shoulder or at the side.

Currently a player has only a couple of options for carrying his/her equipment. The first is using a large, expensive and body odor smelling equipment bag. The second option is to put each piece of equipment directly on the stick handle. This invention enables the player to have ready access to their stick while keeping their gloves, goggles, pads, helmet, etc. intertwined on the device. Once laced together on the device the equipment is free to air out from the perspiration gathered on it during play. Because the equipment is readily seen on the device there is no need for a bag search of equipment when entering into a stadium.

Several preferred embodiments are presented which are specifically designed to hold, protect, organize and carry various pieces of equipment for stick sports.

OBJECTS AND SUMMARY OF THE INVENTION

Accordingly, it is an object of the present invention be a carrier for shafted sports equipment, which overcomes the drawbacks of the prior art, and provides a convenient means for binding and carrying, with the stick being easily accessible for use separately.

The above and many other objects, features and advantages of this invention will be fully appreciated from the ensuing description of selected preferred embodiments, with the description to be read in conjunction with the accompanying Drawing.

DETAILED DESCRIPTION OF THE PREFERRED EMBODIMENT

Figure 1:
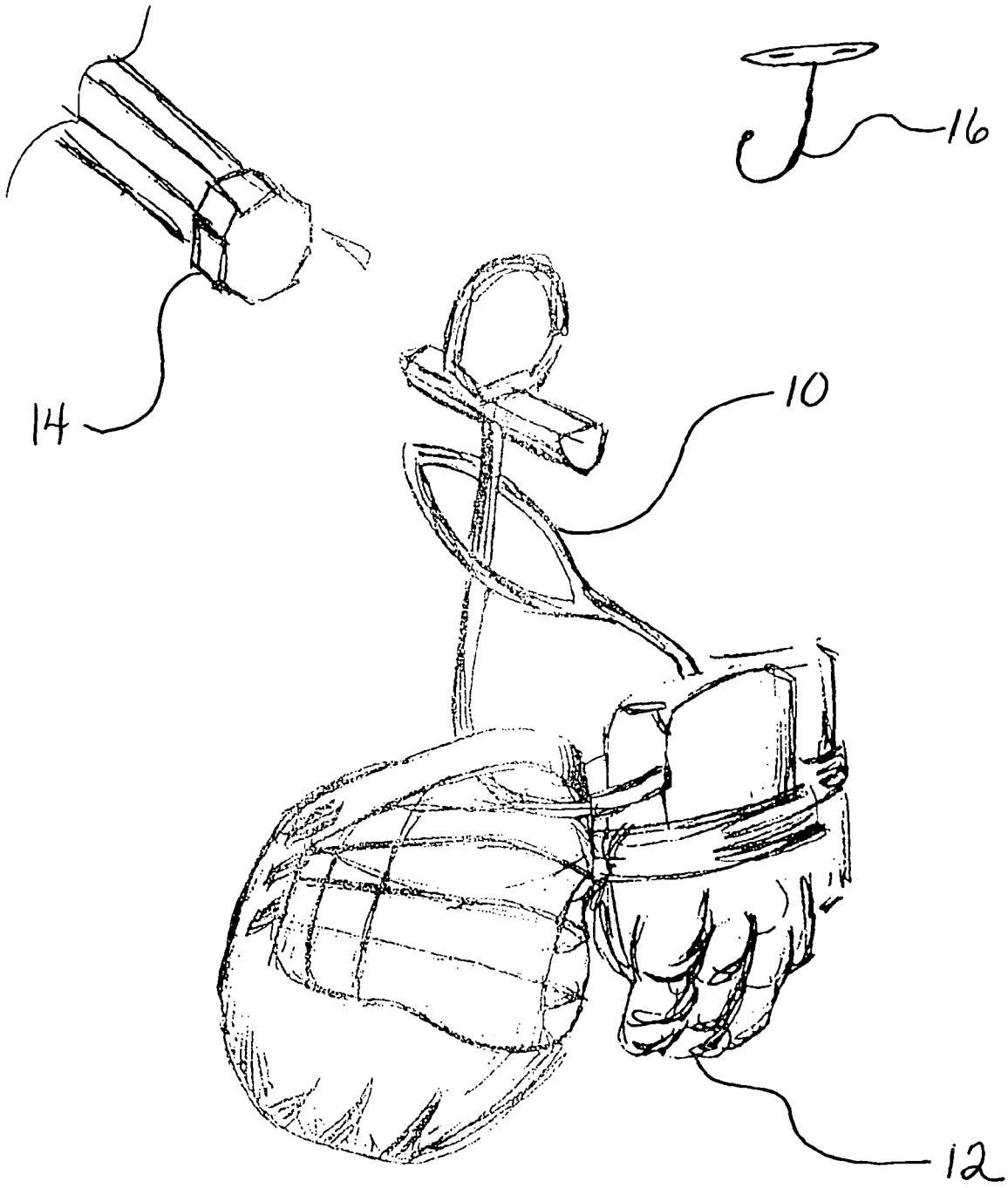
FIG. 1 is a view of the threaded equipment on the carrier ready to be placed on the stick/shaft handle of the stick according to the preferred embodiment of this invention.

With reference now to the drawing, and initially to FIG. 1, the carrier 10 according to the preferred embodiment is shown in use holding various pieces of equipment/gear 12, and with a stick shaft/handle 14 ready to attach through the top loop and handle of the carrier 10. The handle of the carrier 10 is designed to hold the stick shaft 14.

Figure 3:
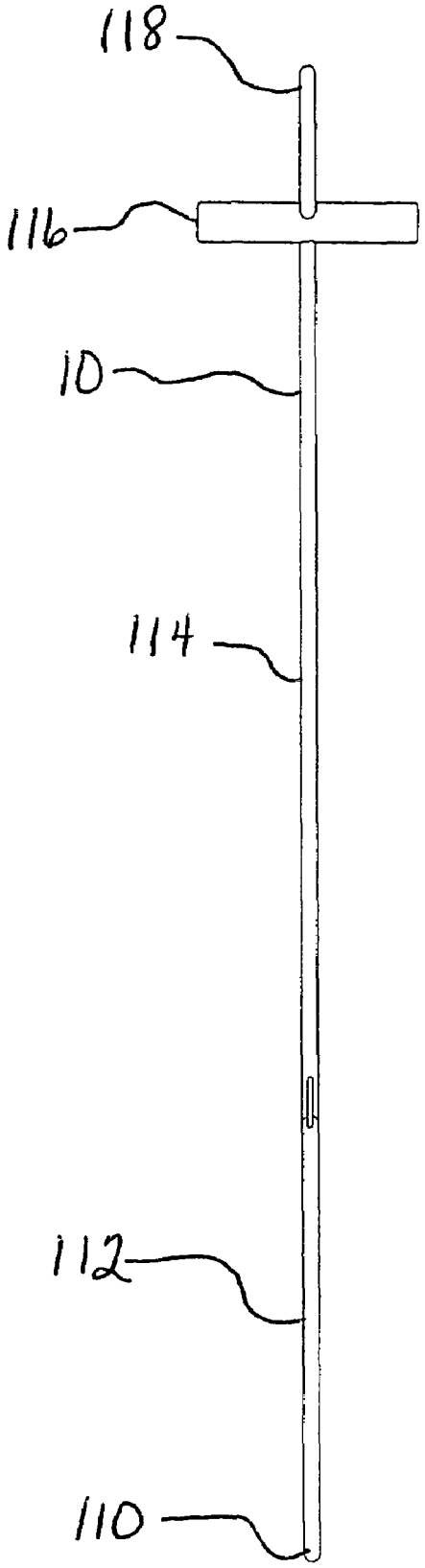
FIG. 3 is a side view of this invention showing the handle of the device.
Figure 2:
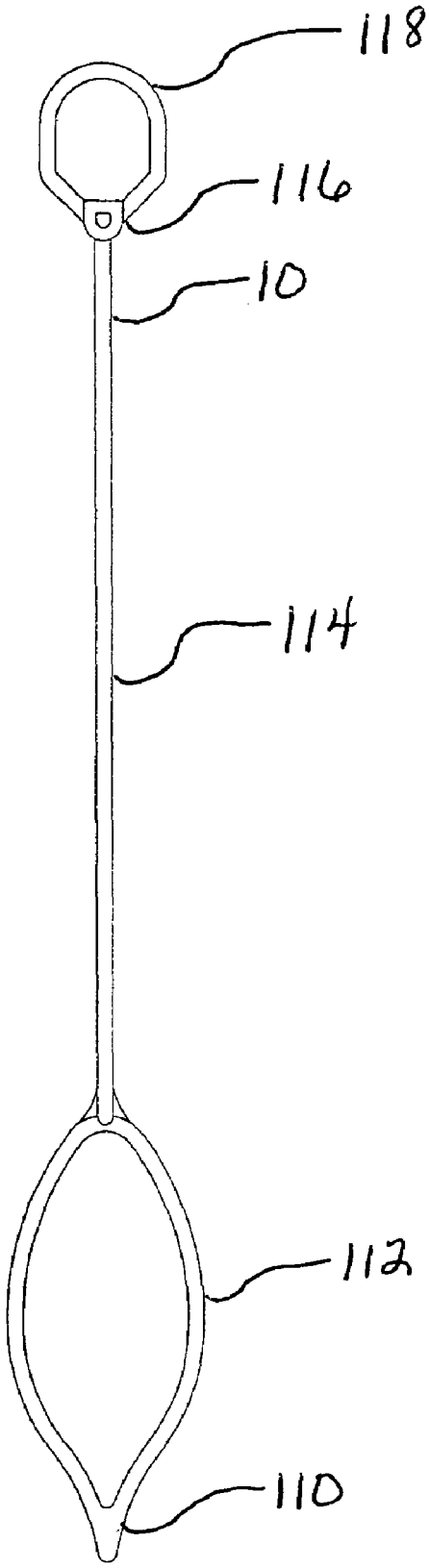
FIG. 2 is a front or back perspective view showing the carrier according to a preferred embodiment of this invention.

As shown in more detail in FIGS. 2 and 3, the carrier 10 of this embodiment is favorably molded of durable rubber or plastic material. Here, the carrier end 110 is molded into a threading point. The large loop 112 is wide enough to accommodate the handle 116 and shaft loop 118 of the carrier 10. The space for equipment 114 is in the middle of the carrier 10. The handle 116 acts as a stop for the space for equipment 114. The shaft loop 118 and handle 116 are small enough for the large loop 112 to fit over after the space for equipment 114 threads or laces through the carrier end 110.

As illustrated in FIGS. 1, 2 and 3 the carrier end 110 threads through the equipment/gear 12, stopped by handle 116 of the carrier 10. The equipment 12 now in the space for equipment 114, the large loop 112 is lifted over the handle 116 and shaft loop 118 with the carrier end 110 resting onto the space for equipment 114 area securing the equipment 12. The handle 116 of the carrier 10 can now be held to receive stick shaft 14 through shaft loop 118. The handle 116 of the carrier 10 can carry the equipment 12 on its own or with the stick shaft 14 through the shaft loop 118 and handle 116 designed to hold the stick shaft 14. The stick shaft 14 can be easily removed from the handle 116 and shaft loop 118 for use in play while keeping equipment 12 secured. The stick shaft 14 can be easily removed with carrier 10, holding equipment 12 being hung from shaft loop 118 onto hook 16 for storage.

While the invention has been described with reference to a specific preferred embodiment, the invention (Thread-it or Lacer) is certainly not limited to that precise embodiment. Rather, many modifications and variations will become apparent to persons of skill in the art without departure from the scope and spirit of the invention, as defined in the appended claims.

I claim:

1. A lacrosse stick in combination with a hand-held equipment carrier, said equipment carrier comprising:

a cord body of material having a first end and a second end and having a central axis along said cord; said first end of body comprising: a formed handle section which is perpendicular to said central axis; said handle having a lacrosse stick holder said holder having a right and left extension members that extend from said handle section said right and left extension members being connected by a U-shaped connector; said second end having two segments that diverge from each other and then converge towards each other to form a tear-drop shaped closed loop; said loop being sized to permit the said handle to pass through said loop and wherein said carrier is molded plastic.

2. The hand-held carrier of claim 1 wherein said carrier is colored.

3. A method for utilizing the device of claim 1 comprising: providing a cord body of material having a first end and a second end and having a central axis along said cord; said first end of body comprising: a formed handle section which is perpendicular to said central axis; said handle having a lacrosse stick holder said holder having a right and left extension members that extend from said handle section said right and left extension members being connected by a U-shaped connector; said second end having two segments that diverge from each other and then converge towards each other to form a tear-drop shaped closed loop; said loop being sized to permit the said handle to pass through said loop; providing various pieces of lacrosse equipment and starting with the pointed, tear-drop end of said second end, threading the device through openings of each piece of lacrosse equipment beyond the second end and central axis, stopped by the formed handle perpendicular to said axis wherein said second end can pass over said first end below said formed handle binding the threaded pieces of equipment and wherein the lacrosse equipment can be removed by lifting the second end over the first end and pulling the formed handle by hand to release the lacrosse equipment from said carrier; providing a lacrosse stick handle that can pass through the U-shaped connector that extends from said handle section and wherein a lacrosse stick handle can be held in one hand and said formed handle section in the other hand to insert and remove the lacrosse stick handle; the carrier can hold the lacrosse equipment and lacrosse stick handle separately and together wherein a lacrosse stick handle can be removed and inserted by one hand leaving the lacrosse equipment bound together and held by said formed handle section in the opposite hand.

* * * * *